US008356501B2

(12) United States Patent
Takahama et al.

(10) Patent No.: US 8,356,501 B2
(45) Date of Patent: Jan. 22, 2013

(54) METHOD OF SUPPLYING LUBRICATING OIL IN COLD-ROLLING

(75) Inventors: Yoshiki Takahama, Futtsu (JP); Toshiyuki Shiraishi, Futtsu (JP); Shigeru Ogawa, Futtsu (JP); Luc Vanel, Ogy (FR); Guy Hauret, Fos sur Mer (FR)

(73) Assignees: Nippon Steel Corporation, Tokyo (JP); Arcelor France, Saint Denis (FR)

( * ) Notice: Subject to any disclaimer, the term of this patent is extended or adjusted under 35 U.S.C. 154(b) by 0 days.

(21) Appl. No.: 13/196,538

(22) Filed: Aug. 2, 2011

(65) Prior Publication Data

US 2011/0283760 A1 Nov. 24, 2011

Related U.S. Application Data

(62) Division of application No. 11/791,091, filed as application No. PCT/JP2005/021497 on Nov. 17, 2005, now Pat. No. 8,047,035.

(30) Foreign Application Priority Data

Nov. 22, 2004 (JP) ..... 2004-337306

(51) Int. Cl.
*B21B 45/02* (2006.01)

(52) U.S. Cl. ..... 72/41; 72/236

(58) Field of Classification Search ..... 72/39, 41, 72/43, 201, 236
See application file for complete search history.

(56) References Cited

U.S. PATENT DOCUMENTS

| | | | |
|---|---|---|---|
| 2,272,368 | A | 2/1942 | Duffy |
| 6,430,980 | B1 | 8/2002 | Weinhold et al. |

FOREIGN PATENT DOCUMENTS

| | | |
|---|---|---|
| JP | 60-223601 | 11/1985 |
| JP | 62-072409 | 4/1987 |
| JP | 63-72417 | 4/1988 |
| JP | 3-151106 | 6/1991 |
| JP | 9-239430 | 9/1997 |
| JP | 2000-094013 | 4/2000 |
| JP | 2002-224731 | 8/2002 |

OTHER PUBLICATIONS

Ma, L. et al., "Film Forming Characteristics of Oil-In-Water Emulsion With Super-Low Oil Concentration", *Colloids and Surfaces A: Physicochemical and Engineering Aspects,* v. 340, Issues 1-3, 2009, pp. 70-76.

Yang, H. et al., "Elastohydrodynamic Film Thickness and Tractions for Oil-in-water Emulsions", *Tribology Transactions,* v. 47, 2004, pp. 123-129.

European Search Report dated Apr. 5, 2012, issued in corresponding European Application No. 10193615.1.

European Search Report dated Apr. 5, 2012, issued in corresponding European Application No. 10193617.7.

*Primary Examiner* — Debra Sullivan
(74) *Attorney, Agent, or Firm* — Kenyon & Kenyon LLP

(57) ABSTRACT

A method of supplying lubricating oil in cold-rolling by emulsion lubrication, characterized by comprising:

using a constant (supply efficiency) obtained under conditions of a specific rolling rate, emulsion supply, emulsion concentration, emulsion temperature, plateout length, rolled material width or roll barrel length, rolling load, grade of the rolled material, and type of lubricating oil and oil film thickness at the time of neat lubrication realized under the specific rolling lubrication conditions to estimate the oil film thickness realized by emulsion lubrication under the specific rolling lubrication conditions and controlling at least one of the emulsion supply, emulsion concentration, emulsion temperature, and plateout length so that the estimated oil film thickness matches with the target oil film thickness.

1 Claim, 2 Drawing Sheets

METHOD OF SUPPLYING LUBRICATING OIL IN COLD-ROLLING

CROSS-REFERENCE TO RELATED APPLICATIONS:

This application is a divisional application under 35 U.S.C. §120 and §121 of prior Application Ser. No. 11/791,091 filed Oct. 30, 2007 now U.S. Pat. No. 8,047,035 which is a 35 U.S.C. §371 of International Application No. PCT/JP2005/021497 filed Nov. 17, 2005, and is hereby incorporated by reference.

TECHNICAL FIELD

The present invention relates to a method of supplying lubricating oil in cold-rolling, more particularly relates to a method of supplying lubricating oil by emulsion lubrication.

BACKGROUND ART

In cold-rolling of steel sheet, from the viewpoints of stabilization of the rolling operation, the shape and surface quality of the product, prevention of seizure, the roll lifetime, etc., it is necessary to maintain the friction coefficient between the rolled material (steel sheet) and the work rolls at a suitable value. To obtain a suitable friction, coefficient, a lubricating oil suitable for the grade, dimensions, and rolling conditions of the rolled sheet is selected and supplied at the inlet side of the rolling stand to the roiled material or rolls.

At the cold-rolling of a steel sheet, in general emulsion lubrication is used. To obtain a suitable friction coefficient, a model is used to control the emulsion supply rate or emulsion concentration.

As methods for controlling lubrication by a model, there are:

(1) The method of estimating and controlling the supply rate of the seizing limit from a constant existing for each rolling condition, concentration, rolling rate, etc. (for example, see Japanese Patent Publication (Kokai) No. 2002-224731), (2) The method of determining the positions of the lubricating oil supply nozzles by considering the time required for oil-water separation at the time the lubricating oil plates out on the steel sheet etc. (phase transition time) (for example, see Japanese Patent Publication (Kokai) No. 2000-094013), etc.

In the past, it was not possible to estimate or measure the oil film thickness at the time of emulsion lubrication. It was possible to arrange an oil film thickness meter at the outlet side of the rolling stand to measure the oil film thickness at the outlet side of the rolling stand, but it was not possible to learn the oil film thickness directly under the roll bite at certain time. As a result, with the above conventional lubricating method, it was not possible to obtain a suitable oil film thickness right under the roll bite and not possible to control, lubrication with a high precision.

Therefore, regarding the above method (1), since it is for the prediction of the seizing limit, use is not possible at a low speed. There is, therefore, room for improvement, of the specific oil consumption in the low speed region. Further, regarding the above method (2), phase transition time is required for plateout of the emulsion lubricating oil. Setting the positions of the lubricating oil supply ends considering the phase transition time is, it is true, effective, but the method of determining the phase transition time is not fixed, therefore there is the problem that the positions cannot) be accurately determined.

SUMMARY OF THE INVENTION

The present invention has as its object to solve the above problem and provide a method of supplying lubricating oil in cold-rolling enabling high precision lubrication control.

(1) A method of supplying lubricating oil in cold-rolling of the present invention provides a method of supplying lubricating oil in cold-rolling by emulsion lubrication, characterized by comprising using "a constant (supply efficiency)" obtained under conditions of a specific roiling rate, emulsion supply, emulsion concentration, emulsion temperature, plateout length, rolled material width or roll barrel length, roiling load, grade of the rolled material, and type of lubricating oil and "oil film thickness" at the time of neat lubrication realized under the specific roiling lubrication conditions to estimate "the oil film thickness" realized by emulsion lubrication under the specific rolling lubrication conditions, and controlling at least one of the emulsion supply, emulsion concentration, emulsion temperature, and plateout length so that the estimated oil film thickness matches with the target oil film thickness.

(2) Another method of supplying lubricating oil of the present invention provides a method of supplying lubricating oil in cold-rolling by emulsion lubrication, characterized by comprising: detecting a load during rolling, an outlet side sheet speed, and a roll speed, calculating in reverse a friction coefficient from an inlet side sheet thickness, outlet side sheet thickness, load, outlet side sheet speed, and roll speed obtained from a reduction schedule, storing in advance the relationship between a constant (supply efficiency) obtained under conditions of a specific rolling rate, emulsion supply, emulsion concentration, emulsion temperature, plateout length, rolled material width or roll barrel length, rolling load, grade of rolled material, and type of lubricating oil and the friction coefficient for each grade of rolled material in a tabular form, finding the friction coefficient under the specific rolling lubrication conditions from the supply efficiency, and controlling at least one of the emulsion supply, emulsion concentration, emulsion temperature, and plateout length so that the friction coefficient matches a target value.

(3) Another method of supplying lubricating oil of the present invention provides a method of supplying lubricating oil in cold-rolling by emulsion lubrication, characterized by comprising: detecting an outlet side sheet speed and roll speed to calculate a forward ratio, storing in advance the relationship between a constant (supply efficiency) obtained under conditions of a specific rolling rate, emulsion supply, emulsion concentration, emulsion temperature, plateout length, rolled material width or roll barrel length, rolling load, grade of rolled material, and type of lubricating oil and the friction coefficient for each grade of rolled material in a tabular form, finding the forward ratio under the specific rolling lubrication conditions from the supply efficiency, and controlling at least one of the emulsion supply, emulsion concentration, emulsion temperature, and plateout length so that the forward ratio matches with a target value.

(4) A method of supplying lubricating oil of the (1), further comprising setting an oil film thickness meter at the rolling stand outlet side, detecting a difference between a measured value of the oil film thickness meter and a measured value of the oil film thickness, periodically correcting the supply efficiency specified by those rolling lubrication conditions, and, while doing so, estimating the oil film thickness of the emulsion lubrication.

(5) A method of supplying lubricating oil of the (2) to (4), further comprising making the supply efficiency obtained under the specific rolling lubrication conditions a function of the rolling rate, emulsion supply, emulsion concentration, emulsion temperature, plateout length, rolled material width or roll barrel length, rolling load, grade of rolled material, and type of lubricating oil.

(6) A method of supplying lubricating oil of the (1) to (5), further comprising making the supply efficiency:

$$\alpha = hemu/hneat$$

where,

α: supply efficiency (function of rolling rate, emulsion supply, emulsion concentration, plateout length, emulsion temperature, rolled material width or work roll barrel length, rolling load, grade of rolled material, and type of lubricating oil)

hemu: oil film thickness of emulsion lubrication realized under specific rolling lubrication conditions hneat: oil film thickness of neat lubrication realized under specific rolling lubrication conditions The method of supplying lubricating oil of the present invention uses the supply efficiency determined by specific rolling lubrication conditions and the oil film thickness at the time of neat lubrication to estimate the oil film thickness at the time of emulsion lubrication and control the emulsion supply rate etc. based on this estimated oil film thickness.

The supply efficiency is a function of the rolling rate, emulsion supply, emulsion concentration, plateout length, emulsion temperature, rolled material width or roll barrel length, rolling load, grade of rolled material, and type of lubricating oil, so the lubrication can be controlled with a high precision.

By high precision lubrication control, a suitable oil film thickness without excess or shortage is formed directly under the roll bite, and the friction coefficient between the rolled material and the work rolls is maintained at a value suitable for the rolling conditions. As a result, it is possible to prevent slip between the rolled material and work rolls and seizure of the rolled material and perform stable rolling. Further, it is possible to reduce the rolling cost and improve the product quality.

THE MOST PREFERRED EMBODIMENT

In the present invention, the supply efficiency obtained under conditions of a specific rolling rate, emulsion supply, emulsion concentration, plateout length, emulsion temperature, rolled material width, rolling load, grade of rolled material, and type of lubricating oil and the oil film thickness at the time of neat lubrication realized under the specific rolling lubrication conditions are used to estimate the oil film thickness realized by emulsion lubrication under the specific rolling conditions.

Further, at least one of the emulsion supply, emulsion concentration, emulsion temperature, and plateout length is controlled so that the estimated oil film thickness matches with a target oil film thickness.

Here, "specific" means specified for each of various rolling lubrication conditions. The "plateout length" means the distance from the emulsion supply position to the inlet of the roll bite enabling a sufficient time to be secured for the lubricating oil in the emulsion supplied to the surface of the running steel sheet to separate from the water and plate out on the surface of the steel sheet.

Further, it is possible to set the plateout length considering the case of supplying lubricating oil to the rolls to be the same. The supply efficiency can be calculated as a function of the rolling rate, emulsion supply, etc. by a model. The supply efficiency can be determined, for example, as follows.

The oil film thickness introduced in the case of neat lubrication under certain rolling conditions is designated by "hneat", while the oil film thickness introduced in the case of emulsion lubrication (any concentration) under the same rolling conditions is designated by "hemu". Under the same rolling lubrication conditions, the oil film thickness at the time of neat lubrication is the maximum, so under emulsion lubrication, the oil film thickness becomes smaller than that at neat lubrication. Therefore, the supply efficiency α is defined as hemu/hneat.

Here, "hemu" can be obtained by measuring the oil film thickness during rolling. And, "hneat" may be measured in advance by conducting actual neat lubrication experiments or may be calculated by lubrication theory etc.

In neat lubrication, along with the increase in the rolling rate, the amount of oil introduced increases due to the wedge effect of the oil and the friction coefficient falls. As opposed to this, in emulsion lubrication, at the low speed region, the amount of oil introduced increases due to the wedge effect of the lubricating oil, but when over a certain rolling rate, the lubrication becomes insufficient, the oil film thickness is reduced, and the friction coefficient increases.

Figure 1:
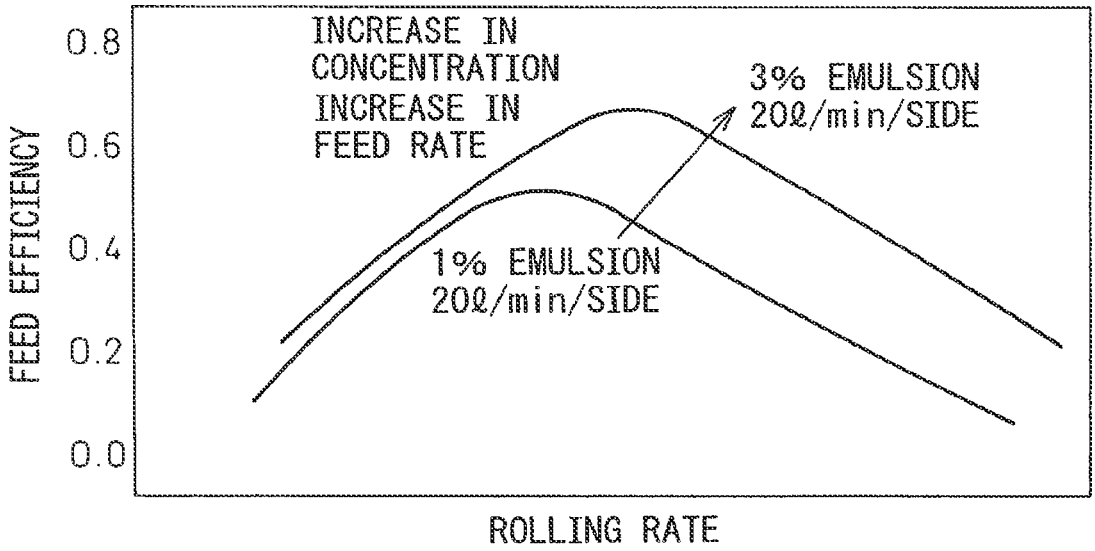
FIG. 1 is a view of an example of the relationship between the rolling rate and supply efficiency when using the emulsion supply and emulsion concentration as parameters.

If calculating the supply efficiency for each rolling rate according to the definitions, the result becomes as shown in FIG. 1. The inventors discovered that this curve differs depending on the emulsion supply rate, emulsion concentration, plateout length, emulsion temperature, rolled material width or roll barrel length, rolling load, grade of the rolled material, and type of the lubricating oil, but if these rolling lubrication conditions are the same, becomes equal at all times.

Therefore, by creating a model of the supply efficiency in advance within the range of operation, it is possible to estimate the oil film thickness directly under the roll bite at the time of emulsion lubrication through this supply efficiency and the oil film thickness at the time of neat lubrication.

Therefore, if controlling the emulsion concentration or emulsion supply so that the estimated oil film thickness matches with the target value, it becomes possible to supply the lubricating oil without excess or shortage under rolling lubrication conditions.

Further, the inventors discovered that it is possible to estimate the supply efficiency from the rolling rate, emulsion supply, emulsion concentration, plateout length, emulsion temperature, rolled material width or roll barrel length, rolling load, grade of rolled material, and type of lubricating oil. The equation for estimation of the supply efficiency may be set by fitting to the values obtained by experiments by a suitable function.

The inventors confirmed that the supply efficiency can be expressed by at least an exponential function for each of the low speed region and high speed region. Any other function enabling suitable fitting may also be used of course.

However, the low speed region and high speed region are defined using the maximal value of the supply efficiency as a boundary. It is known that α can be estimated by a model equation, so this function (hemu=α×hneat) may be used to estimate the oil film thickness at the time of emulsion lubrication from the oil film thickness at the time of neat lubrication (actually measured or using values of fluid theory of lubrication) under conditions the same as the lubricating oil supply conditions at the time of emulsion lubrication (emulsion supply, emulsion concentration, emulsion temperature, and plateout length).

Therefore, it is possible to estimate the supply efficiency on-line at all times, estimate the oil film thickness at the time of specific emulsion lubrication, and thereby control the lubrication.

The simplest parameter as a control factor is the emulsion supply rate. The number of lubrication tanks etc. may be used to change the emulsion concentration. Similarly, the directions of the nozzles may be changed to change the plateout length.

Figure 2:
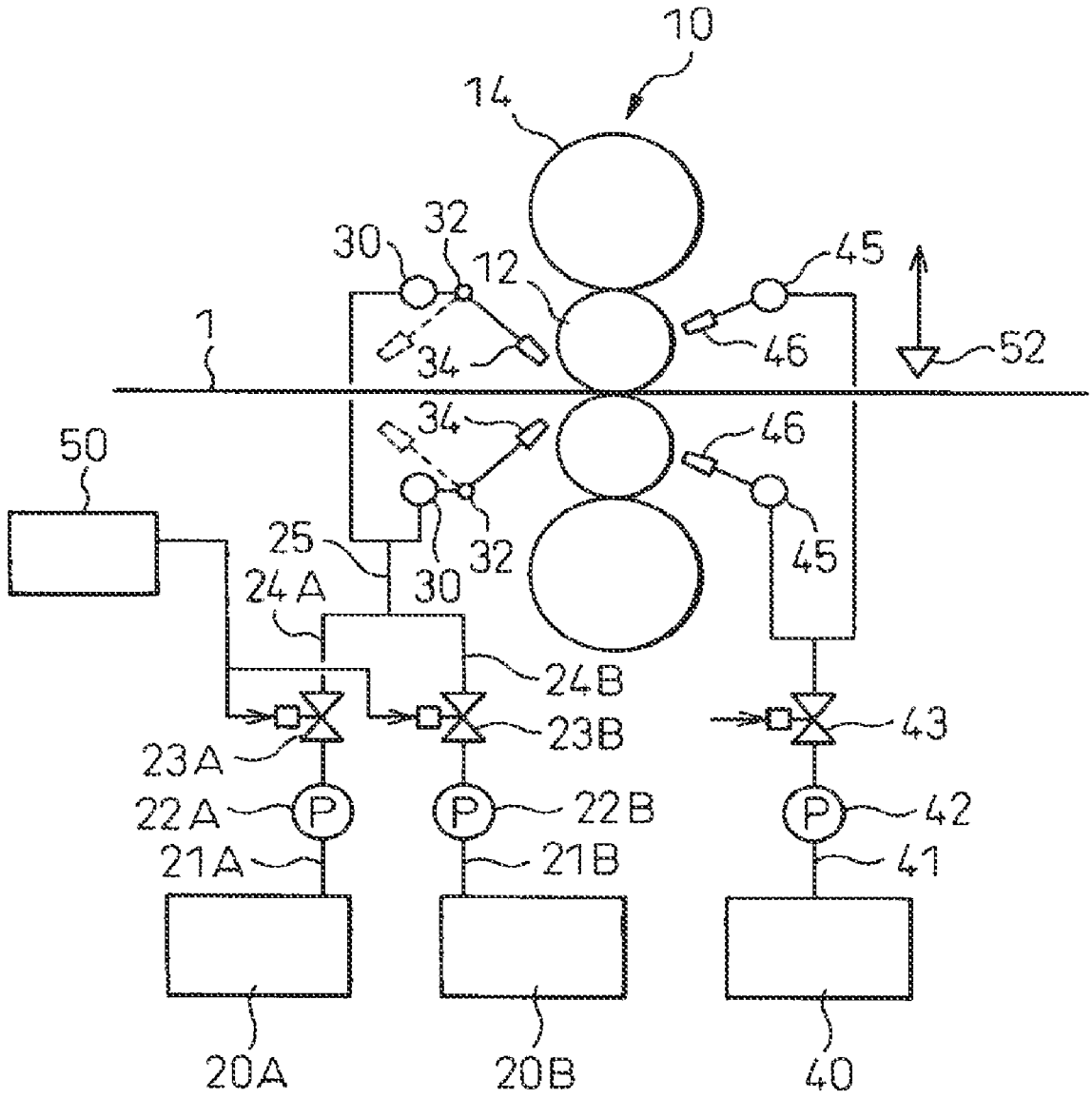
FIG. 2 is a view schematically showing an example of a rolling facility for working the method of supplying lubricating oil of the present invention.

FIG. 2 is a view schematically showing an example of a rolling facility for working the method of supplying lubricating oil of the present invention. The rolling facility is for example comprised of five stands. FIG. 2 shows only one rolling stand 10 among them. The rolling stand 10 is a 4Hi rolling stand provided with work rolls 12 and backup rolls 14.

The rolling facility is provided with emulsion tanks 20A and 20B for storing the emulsion and a cooling water tank 40. The stored emulsion is set in advance in type and concentration in accordance with the specific rolling lubrication conditions since the type and/or concentration of the lubricating oil differs.

The emulsion pipes 21A and 21B connected to the emulsion tanks 20A and 205 have emulsion pumps 22A and 22B and emulsion flow rate adjustment valves 23A and 235 attached to them. Further, the emulsion pipes 21A and 21B are connected to a main pipe 25.

At the inlet side of the rolling stand 10, an emulsion header 30 is arranged. The emulsion header 30 is provided with a plurality of emulsion nozzles 34 via rotary joints 32 along the sheet width direction.

Each emulsion nozzle 34 is able to rotate by the rotary joint 32 about an axis of rotation extending horizontally in the sheet width direction. The emulsion nozzles 34 can be rotated to change the directions of spraying the emulsion as shown by the broken lines and thereby adjust the plateout length.

The cooling water pipe 41 extending from the cooling water tank 40 has a cooling water pump 42 and cooling water flow rate adjustment valve 43 attached to it. On the other hand, a cooling water header 45 is arranged at the outlet side of the rolling stand 10. The cooling water header 45 has the cooling water pipe 41 connected to it and has a plurality of cooling nozzles 46 attached to it along the sheet width direction.

The rolling facility is provided with a lubrication control apparatus 50 comprised of a computer. The lubrication control apparatus 50 stores model equations of the rolling lubrication conditions and supply efficiency $\alpha$ and other data. The lubrication control apparatus 50 calculates the supply efficiency a by the model equations based on the given rolling lubrication conditions.

In the rolling facility configured as explained above, if, for example, the emulsion EA is selected based on the rolling lubrication conditions and supply efficiency $\alpha$, the emulsion pump 22A is driven and the emulsion EA is sent from the emulsion tank 20A through the emulsion pipe 21A to the main pipe 25. The operation signal from the lubrication control apparatus 50 may be used to adjust the flow rate of the emulsion flow rate adjustment valve 23A.

At this time, the emulsion pump 22B is stopped and the emulsion flow rate adjustment valve 23B is closed. The emulsion EA is supplied through the main pipe 25, emulsion header 30, and rotary joints 32 from the emulsion nozzles 34 to the steel sheet 1 at the inlet side of the rolling stand. Further, the work rolls 12 are cooled with cooling water sprinkled from the cooling water nozzles 46.

The rolling lubrication conditions change with each instant, so if a new supply efficiency $\alpha$ is calculated, for example it is possible to leave the other conditions constant and change only the plateout length to change the oil film thickness. The changed parameter is not limited to the plateout length and may also be the emulsion supply rate or the emulsion temperature. Further, it is also possible to change several of these parameters.

Further, if the rolling lubrication conditions change and a new supply efficiency $\alpha$ is set, the emulsion pump 22A is stopped and the emulsion flow rate adjustment valve 23A is closed in some cases. Further, the emulsion pump 21B is driven and the emulsion flow rate adjustment valve 23B is used to adjust the flow rate of the emulsion EB.

The emulsion is supplied while switching from the emulsion EA to the emulsion EB and changing the emulsion supply. Note that in this case, the lubricating oil may be the same or different in type, and the emulsion supply rate may be the same. Further, it is also possible to change the plateout length.

When periodically correcting the supply efficiency (learning function), an oil film thickness meter 52 is set at the rolling stand outlet side. The measured value detected by the oil film thickness meter is sent to the lubrication control apparatus 50 where the difference between the measured value of the oil film thickness meter and the estimated value of the oil film thickness was calculated. Further, based on the detected difference, the supply efficiency under the rolling lubrication conditions was periodically corrected while estimating the oil film thickness of the emulsion lubrication.

Due to this, it is possible to further raise the precision of the lubrication control. The period of the correction may be changed in any way in accordance with the rolling lubrication conditions.

The supply efficiency $\alpha$ is a parameter showing the state of lubrication, so is directly correlated with the friction coefficient or forward ratio. These friction coefficient and forward ratio are governed by how much lubricating oil is introduced into the roll bite. The rate of oil introduced is affected by the state of supply, that is, the emulsion concentration, supply rate, plateout length, etc., so the relationship with the supply efficiency $\alpha$ is deep.

It is possible to investigate in advance the friction coefficient or forward ratio and supply efficiency and calculate the supply efficiency from the lubricating oil supply conditions to estimate the friction coefficient or forward ratio. When the calculated friction coefficient or forward ratio does not match the target value, it is possible to change the supply rate, plateout length, or other parameters to obtain the target state of lubrication.

Therefore, in the present invention, it is possible to detect the load during the rolling, outlet side sheet speed, and roll speed, calculate in reverse the friction coefficient from the inlet side sheet thickness and outlet side sheet thickness obtained from the reduction schedule and the above parameters, store the relationship between the friction coefficient and the supply efficiency for each grade of rolled material in advance in the form of a table, find the friction coefficient under specific rolling conditions from the supply efficiency, and control at least one of the emulsion supply, emulsion concentration, emulsion temperature, and plateout length so that the friction coefficient matches with a target value.

Further, it is possible to detect the outlet side sheet speed and roll speed to calculate the forward ratio, store the relationship between the forward ratio and the supply efficiency for each grade of the rolled material in advance in the form of a table, find the forward ratio under specific-rolling conditions from the supply efficiency, and control at least one of the emulsion supply, emulsion concentration, emulsion temperature, and plateout length so that the forward ratio matches with the target value.

However, even under the same lubricating oil supply conditions, it is known that the friction coefficient or the forward ratio changes according to the roll wear, the grade of the rolled material, etc. The roil wear should be corrected by the number of tons of rolling of the rolled material from after roll-exchange. The grades of the rolled material, for example, are classified by deformation resistance to less than 350 MPa, 350 to 600 MPa, 600 to 800 MPa, 800 to 1200 MPa, and more than 1200 MPa. There is no problem if storing the relationship between the friction coefficient or forward ratio and supply efficiency for each in the form of a table.

The present invention is not limited to the above embodiments. For example, the rolled material may also be, in addition to steel, titanium, aluminum, magnesium, copper, or another metal and alloys of these metals.

There may also be three or more emulsion tanks. Further, it is also possible to use a single tank for storing the lubricating oil and mix the lubricating oil supplied out from the tank with heated water in the middle of the pipe to prepare the emulsion.

In this case, it is also possible to change the mixing ratio of the lubricating oil, and heated water in accordance with the rolling lubrication conditions and adjust the emulsion concentration and/or change the emulsion supply rate.

EXAMPLES

A single stand 4Hi test mill was used to roll a coil. In this experiment, palm oil was used as the base oil of lubricating oil (emulsion concentration 2%, plateout length 0.3 m, supply rate 1 liter/min per side, sheet width 50 mm) and the supply efficiency was calculated in advance in a preliminary test in the range of conditions of the test. The rolling was performed by accelerating, rolling at a constant 1500 mpm for 10 minutes, then decelerating and ending.

The present model was applied to a first coil (calculation period of 1 second), whereby $\alpha$ was between 0.11 to 0.23. The sheet was rolled while changing the supply so that the estimated oil film thickness (current 0.38 to 0.48 μm) matched with the target oil film thickness. The target oil film thickness was made an oil film thickness at the time of the limit of occurrence of seizure flaws obtained by operation up to here. When using the present model, rolling was possible without problems such as seizure flaws.

Even with ordinary rolling, the supply rate is changed for each rolling rate, but this is rough control by table values. Therefore, the rolling is not performed in the state close to the limit of seizure at all times like in the present model.

If calculated by table values used in ordinary operation, it is learned that the supply rate by the present experiment is 92% of ordinary operation (after correction of sheet width). It could be confirmed by the present model that the cost can be cut without any trouble.

Next, the supply efficiency was calculated during rolling while conducting similar experiments. For verifying the precision of the supply efficiency estimation model as well, the combination of the rolling conditions and sheet thickness and width was changed to roll 23 coils. No rolling trouble occurred for any coil including seizure flaws.

In the same way as the previous time, if compared with the supply at the time of normal operation, in the present experiment, it could be confirmed that the supply was 93% in normal operation. The effect could be confirmed even in the case of estimating the supply efficiency during rolling.

Industrial Applicability

As explained above, the present invention enables lubrication control with a high precision in rolling control. Therefore, the present invention is great in applicability in the ferrous metal industry.

The invention claimed is:

1. A method of supplying lubricating oil in cold-rolling by emulsion lubrication, comprising:

detecting a load during rolling, an outlet side sheet speed, and a roll speed, calculating a friction coefficient from an inlet side sheet thickness and an outlet side sheet thickness obtained from a reduction schedule, and the load, the outlet side sheet speed, and the roll speed, controlling at least one of emulsion supply, emulsion concentration, emulsion temperature, and plateout length so that the friction coefficient matches a target value, wherein said controlling is performed by a method comprising:

storing in advance a relationship between said friction coefficient and a supply efficiency obtained for specific rolling lubrication conditions of rolling rate, emulsion supply, emulsion concentration, emulsion temperature, plateout length, rolled material width or roll barrel length, rolling load, grade of rolled material, and type of lubricating oil for each grade of rolled material in a tabular form, finding a friction coefficient under said specific rolling lubrication conditions from said supply efficiency, calculating a control value of said at least one of emulsion supply, emulsion concentration, emulsion temperature, and plateout length, controlling said at least one of emulsion supply, emulsion concentration, emulsion temperature, and plateout length to said control value so that the friction coefficient matches the target value,.

wherein the supply efficiency is defined as:

$$\alpha = hemu/hneat$$

where, $\alpha$: supply efficiency which is determined as a function of rolling rate, emulsion supply, emulsion concentration, plateout length, emulsion temperature, rolled material width or work roll barrel length, rolling load, grade of rolled material, and type of lubricating oil hemu: oil film thickness of emulsion lubrication under said specific rolling lubrication conditions hneat: oil film thickness of neat lubrication under said specific rolling lubrication conditions.

* * * * *

UNITED STATES PATENT AND TRADEMARK OFFICE

CERTIFICATE OF CORRECTION

PATENT NO. : 8,356,501 B2
APPLICATION NO. : 13/196538
DATED : January 22, 2013
INVENTOR(S) : Yoshiki Takahama et al.

It is certified that error appears in the above-identified patent and that said Letters Patent is hereby corrected as shown below:

On the Title page, Item [62], change "Division of application No. 11/791,091, filed as application No. PCT/JP2005/021497 on Nov. 17, 2005, now Pat. No. 8,047,035" to -- Division of application No. 11/791,091, filed on October 30, 2007, now U.S. Pat. No. 8,047,035 --;

In the Specification

Column 1, line 27, change "friction, coefficient" to -- friction coefficient --;

Column 1, line 55, change "to control," to -- to control --;

Column 1, line 59, change "improvement," to -- improvement --;

Column 1, line 66, change "cannot)" to -- cannot --;

Column 2, line 9, change "by comprising using" to -- by comprising: using --;

Column 2, line 10, change "roiling" to -- rolling --;

Column 2, line 12, change "roiling" to -- rolling --;

Column 2, line 65, change "of the (2) to (4)" to -- of the (1) to (4) --;

Column 5, line 29, change "205" to -- 20B --;

Column 5, line 30, change "235" to -- 23B --;

Column 5, lines 54-55, change "supply efficiency a" to -- supply efficiency α --; and In the Claim Column 8, line 46, change "value,." to -- value, --.

Signed and Sealed this
Fourth Day of February, 2014

Michelle K. Lee

Michelle K. Lee
*Deputy Director of the United States Patent and Trademark Office*